United States Patent [19]

Drake

[11] 4,079,856

[45] Mar. 21, 1978

[54] STORAGE TANK SEAL

[75] Inventor: Paul Hammond Drake, London, England

[73] Assignee: The British Petroleum Company Limited, London, England

[21] Appl. No.: 698,140

[22] Filed: Jun. 21, 1976

[30] Foreign Application Priority Data

Jul. 2, 1975 United Kingdom ..... 27847/75

[51] Int. Cl.[2] ..... B65D 87/2

[52] U.S. Cl. ..... 220/225; 220/85 B

[58] Field of Search ..... 220/85 A, 85 B, 216–227

[56] References Cited

U.S. PATENT DOCUMENTS

| | | | |
|---|---|---|---|
| 1,597,399 | 8/1926 | Wilson | 220/216 |
| 2,269,568 | 1/1942 | Wilkin | 220/85 B X |
| 2,578,090 | 12/1951 | Plummer | 220/85 B |
| 2,670,100 | 2/1954 | Fino et al. | 220/85 B |
| 3,028,040 | 4/1962 | Woodard et al. | 220/85 B |
| 3,355,271 | 11/1967 | Soan et al. | 220/85 B |

FOREIGN PATENT DOCUMENTS

| | | | |
|---|---|---|---|
| 478,412 | 11/1951 | Canada | 220/216 |
| 1,081,523 | 12/1954 | France | 220/225 |
| 1,116,444 | 5/1956 | France | 220/216 |
| 1,298,326 | 11/1962 | France | 220/85 B |
| 1,529,039 | 10/1969 | Germany | 220/218 |
| 725,491 | 3/1955 | United Kingdom | 220/218 |

*Primary Examiner*—Stephen Marcus

*Attorney, Agent, or Firm*—Morgan, Finnegan, Pine, Foley & Lee

[57] ABSTRACT

Liquid storage tank uses a collapsible bag of impermeable material which floats on the stored liquid and moves with the liquid, thus giving reduced vapor pressure above the liquid. In use, the collapsible bag has a tapered form so as to reduce the possibility of its contact with the tank side walls and hence reduce the sticking tendency of the bag to the walls.

13 Claims, 4 Drawing Figures

STORAGE TANK SEAL

The present invention relates to seals for storage tanks, especially tanks for the storage of oils and volatile petroleum products.

In conventional storage tanks for oil there is a significant loss of the product stored to the atmosphere during the filling of such tanks. Volatile liquids are also lost generally due to "breathing" caused, e.g. by daily temperature variations.

The high cost of petroleum products has prompted a reappraisal of the cost effectiveness of methods of reducing vapour losses of these products. The use of floating decks is a well known attempt to solve this problem and another technique is the use of a floating roof system comprising a collapsible bag of impermeable material which floats on the stored liquid and moves with the liquid thus giving a reduced vapour space above the liquid. This latter method is more simple, avoids the use of a sliding seal and is less expensive in installation costs than the use of the floating decks.

However, in practice, the collapsible bag technique has certain disadvantages, one of the most significant being the tendency of the collapsible bag to stick to the storage tank walls. This sticking prevents the collapsible bag from moving up and down in the tank following the liquid level and applies severe stretching forces to the bag when there is a substantial contact area between the bag and the walls of the tank.

The present invention is directed towards the improvement of the performance of collapsible bag type vapor barriers.

Thus according to the invention there is provided a liquid storage tank comprising:

a rigid shell having substantially vertical walls and, a collapsible bag dividing the interior of the rigid shell into an air space and a liquid space, and a fixed peripheral collar around the walls of the shell and attached to the collapsible bag, the peripheral collar acting to support the collapsible bag, to form a seal between the collapsible bag and the walls of the tank and also tending to space apart the bag from the walls of the tank.

In one embodiment of the invention, the collapsible bag in its fully extended form comprises a cylinder or truncated cone, having circumferential bracing rings the diameter of the rings being less than the tank diameter. The rings are preferably made from steel. As the tank fills with liquid, the rings and bag collapse together like a concertina and open out again as the tank empties.

In a second embodiment of the invention, the collapsible bag in its fully extended form, comprises a truncated cone which tapers away from the open end of the bag and is sufficiently rigid to maintain the walls of the bag apart from the side walls of the tank. Preferably the degree of taper of the cone is from 1° to 10° from the vertical.

Preferably the fixed peripheral collar is placed above the upper liquid level in the tank and most preferably forms an integral part of the collapsible bag.

The collapsible bag may terminate at the peripheral collar, the bag being then in effect a simple membrane and in which case, the mouth may be pinched between the peripheral collar and the tank walls. Preferably, however, the bag continues above the collar with the mouth being fixed to a vent port of the tank in the roof of the tank and thus may give a further primary seal against vapour egress through the vent port. (This is particularly important when storing volatile products).

The fixed peripheral collar preferably comprises an inflatable tube which is inflated against the upper side wall of the tank to form a seal and support and to minimise vertical movement of the collar. To assist in achieving the latter requirement, the collar may be inflated into a peripheral recess or the like in the tank walls. Flanges and indentations on the tank wall may also be used to assist in holding the collar in place. The tube desirably, as in the case of the collapsible bag, is made of a vapor impermeable material but is preferably of stronger construction than the collapsible bag. Thus, it may be made of a synthetic or natural rubber e.g. a butadiene-acrylonitrite co-polymer and have a wall thickness of preferably from 0.05 to 15 mms.

Preferably the inflatable tube has a connection to a suitable port in the tank roof so as to allow inflation and maintenance of inflation from an external pressurising source. A particular advantage arising from the use of an inflatable tube is that the tube in collapsed form and the bag connected to it can be inserted through a relatively small hole in the tank roof and then is inflated into position. Thus, the present invention is particularly suitable for adding a seal to existing tanks and even with new tanks there is no necessity to position the tube and bag prior to adding the tank roof. The bag and/or tube may have one or more lines of, for example, a nylon rope connecting it to the tank roof to give extra support. If such lines pass through a port, the bag and tube can be withdrawn and replaced easily in the event of either the bag or tube being damaged.

The dimensions of the peripheral collar are preferably chosen so that the collapsible bag (at the collar) is spaced from the tank walls by a distance of 1 to 10% of the depth of the tank i.e. the tank depth from the collar to the tank base.

For storage of petroleum products it is desirable that the permeation rate of such products through the collapsible bag is very small for economic and conservation reasons. Thus preferably for storage of petroleum products, the bag is fabricated from polyvinyl fluoride (Tedlar), polyvinylidene chloride (Saran), or polyester (Mylar) films.

For the above-mentioned plastics materials, the thickness of the collapsible bag typically varies from 10 to 70 micrometers. Preferably the collapsible bag is fabricated in sections which are heat sealed together to give a gas tight seal.

Preferably anti-static compounds are incorporated into the collapsible bags to avoid build up of static charges which would be hazardous if, for example the storage tanks are used for containment of petroleum products.

The collapsible bag preferably incorporates means for dipping of the tank. Preferably the collapsible bag comprises a short length of pipe passing through and sealingly attached to the bag, the pipe also having a lid closure which may be opened for dipping of the tank. Most preferably, the pipe incorporates a flotation collar to improve vertical stability and prevent sinking during installation of the collapsible bag.

The invention will now be described by way of example only with reference to the drawings accompanying the Specification.

Figure 1:
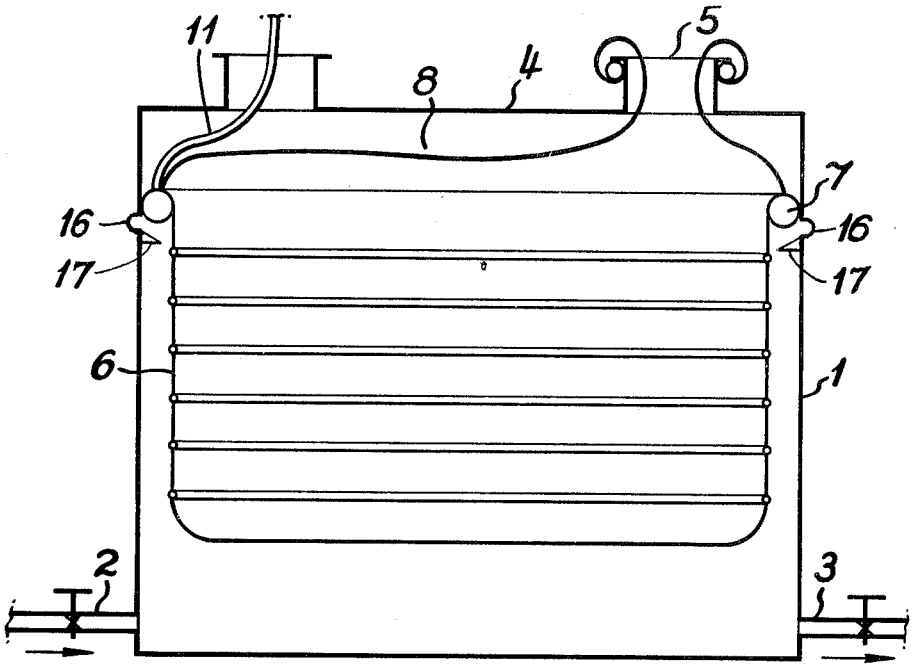
FIG. 1 shows a diagrammatic cross-section of a storage tank having a floating seal incorporating circumferential bracing.

The storage tank 1 has an inlet 2 and an outlet 3 for filling and emptying with the stored liquid usually a petroleum product. The tank 1 has a steel roof 4 having one or more vents 5 through which access to the tank interior may be gained for installation and support. The tanks usually incorporate a pressure-relief valve for release of excess air pressure.

The collapsible bag 6 is made of a suitable liquid impervious material which is inert, resistant to tearing or puncture and flexible. The permeation rates of 100 octane motor spirit through some plastics materials are shown in Table 1. The values obtained show that any materials as good as or better than Saran 19 may be used for tanks containing motor spirit.

Table 1

Permeation Rate (in g/m²/24 hours) of 100 octane Motor Spirit through Polymer Films

| | FILM THICKNESS | TEMPERATURE (° C) | | | |
|---|---|---|---|---|---|
| | | 0* | 20 | 30 | 40 |
| SARAN 19 | 50 | — | 0.8–1.8 | 1.2–2.2 | 2.4 |
| SARAN WRAP | 25 | — | 0.9–1.2 | — | — |
| TEDLAR 100 SG | 20 | <.005 | 0.02 | 0.25 | 0.39 |
| TEDLAR 200 SG | 40 | <.005 | 0.01 | 0.03 | 0.225 |
| TEDLAR 100 BM | 25 | <.005 | 0.01–0.02 | — | — |
| MYLAR | 10 | v.small | <0.01 | .08–.12 | 0.15 |
| HDPE | 40 | — | 470 | — | — |
| LDPE | 40 | — | 1300 | — | — |

*Estimated values
(HDPE, LDPE - high density, low density polyethylene)
(Film thickness is expressed in micrometers)

The bag is inserted in the tank 1 and is of such a size that when the tank is empty, the bag 6 substantially fills the interior of the tank in the form shown in FIG. 1.

The bag 6 is held in position against the wall of tank 1 by means of a peripheral inflatable collar 7. A flexible connector tube 11 serves to inflate the collar 7 and also may be used to retrieve a defective collar or bag. Peripheral recess 16 or flange 17 can be used to assist in holding the collar in place. The bag 6 may be permanently welded to the collar 7 or the edges of the bag 6 may be passed over the collar 7 which is then inflated so as to pinch the bag 6 against the walls of tank 1. The bag 6 passes over the top and inside of collar 7 otherwise it is found that the friction between the bag 6 and tank 1 is so great that sticking of the bag 6 occurs on the tank walls. The bag 6 is clamped at the access port forming a primary seal at 5.

As liquid is passed into tank 1 through inlet 2, the liquid presses against the underside of bag 6, thus collapsing the bag and expelling air from the tank interior 8 and through the vents 5. Because of the impermeable nature of bag 6, this expelled air will contain no or little vapor from the stored liquid. Filling continues as necessary or until, for example, a safety shut-off circuits interrupts the filling operation. Similarly, when the tank is emptied, the collapsible bag 6 moves downward with the liquid level and atmospheric air passes in through the vents 5 to replace the volume left by the liquid.

Figure 2:
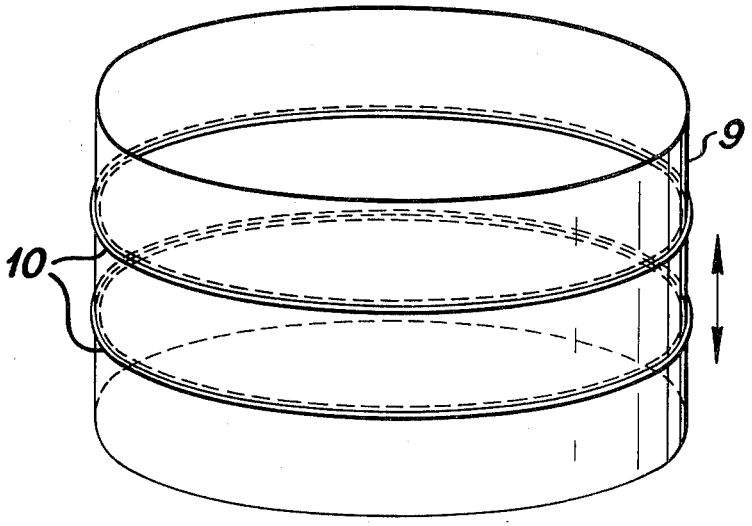
FIG. 2 shows a diagrammatic representation of the bracing of the seal.

FIG. 2 illustrates the structure of the collapsible bag 6 in more detail. The bag is formed from panels of impermeable plastics material e.g. Tedlar, Saran, Mylar which are heat welded together, in the form of a closed cylinder 9. The bag is re-inforced with circumferential steel bands or rings or pneumatic rings 10 which cause the bag 6 to concertina as the liquid level in the tank moves up and down.

Figure 3:
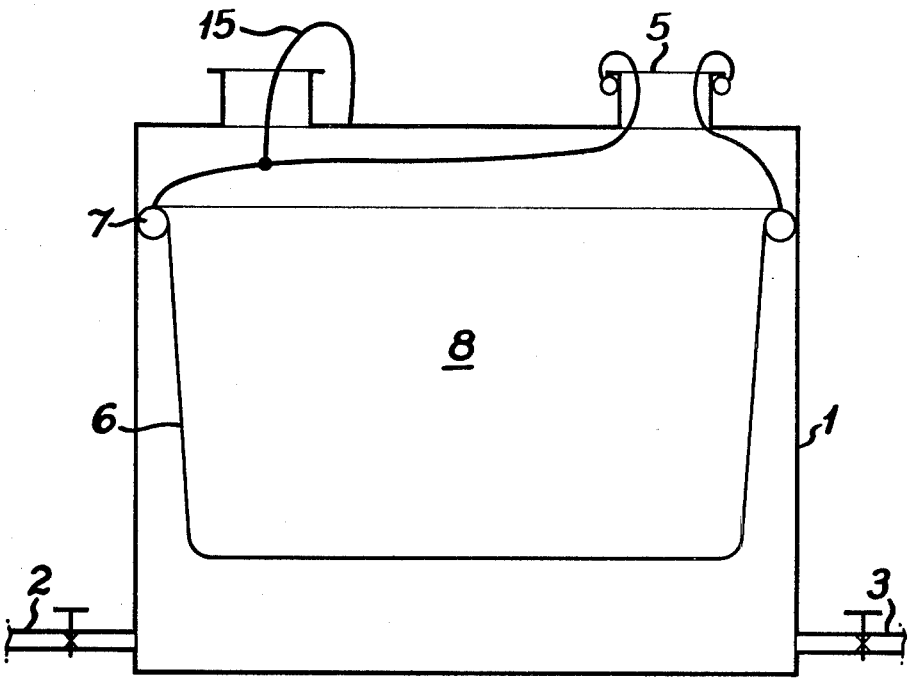
FIG. 3 shows a storage tank having a floating seal, the edges of which are tapered.

FIG. 3 shows a further embodiment of the invention. In this case, the steel bracing rings 10 are not used. Instead the collapsible bag is made to have sides which taper away from the tank walls. This tapering of the bag reduces the tendency of the bag to stick against the tank walls due to wall/bag frictional forces being set up. The bag may be retrieved by line 15 which may also act as an extra support.

Figure 4:
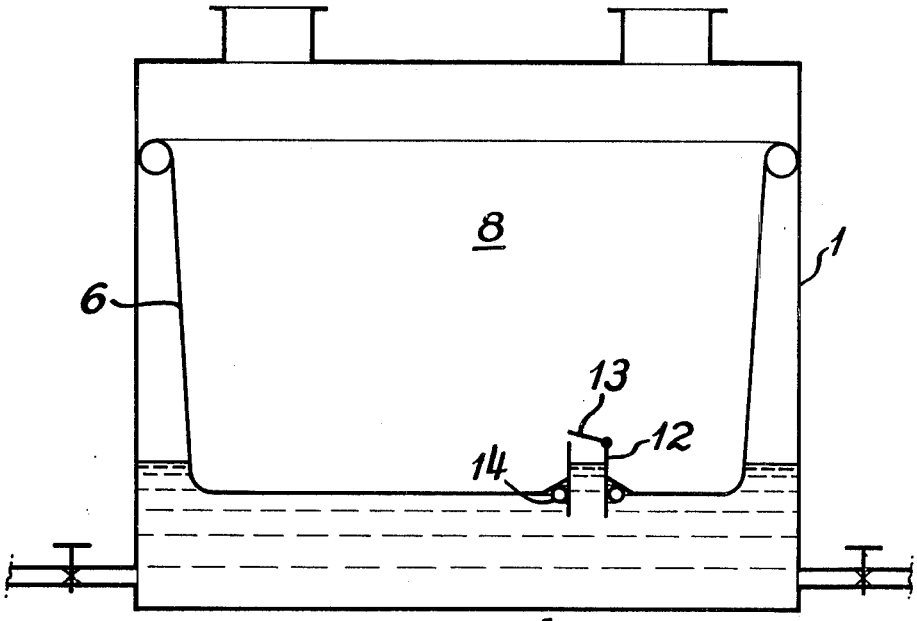
FIG. 4 shows a storage tank having a floating seal incorporating a dipping modification.

FIG. 4 shows a further modification to the tank seal which enables dipping e.g. for test purposes to be carried out in the same manner as used on conventional floating roofs.

The modification consists of a short length of pipe 12 welded into the base of bag 6. The pipe 12 has a lid seal 13 which can be raised from the roof of tank 1 when dipping is desired and which prevents vapor emission when closed. The pipe 12 includes a flotation collar 14 which improves the vertical stability and prevents sinking during installation of bag 6. The length of the pipe 12 above the base of the bag 6 is chosen so that the displacement due to the bag 6 is always sufficient to raise the bag 6 and overcome frictional forces before liquid enters the tank interior 8 through the pipe 12.

I claim:

1. A liquid storage tank, comprising:

(a) a rigid shell having substantially vertical side walls;

(b) a collapsible bag of impervious flexible sheet material positioned within said tank and dividing the interior of the rigid shell into an air space and a liquid space, said collapsible bag having a mouth portion on a section thereof;

(c) an inflatable peripheral collar attached to said collapsible bag, said inflatable collar being inflated against the side walls of said tank to support said collapsible bag and to space apart said bag from the side walls of said tank; and (d) a vent port disposed in said shell having an external portion extending outwardly from said shell, said mouth of said collapsible bag being sealably attached to the external portion of said vent port to provide a primary seal for preventing the egress of vapors which is located outside the shell of said tank.

2. A liquid storage tank according to claim 1 in which the collapsible bag in its fully extended form comprises a truncated cone having sufficient rigidity to maintain the walls of the bag apart from the side walls of the tank.

3. A liquid storage tank according to claim 1 in which the inflatable collar is inflated into a peripheral recess in the side walls of said tank to assist in holding the collar in place.

4. A liquid storage tank according to claim 1 in which the inflatable collar is supported by flanges disposed in the side walls of said tank to assist in holding the collar in place.

5. A liquid storage tank according to claim 1 in which the collapsible bag in its fully extended form comprises a truncated cone which tapers away from the open end of the bag.

6. A liquid storage tank according to claim 5 in which the degree of taper of the cone is 1° to 10° from the vertical.

7. A liquid storage tank according to claim 1 in which the collapsible bag in its fully extended form comprises a cylinder having circumferential bracing rings, the diameter of the rings being less than the storage tank diameter.

8. A liquid storage tank according to claim 1 in which the peripheral collar is positioned above the liquid level in the tank.

9. A liquid storage tank according to claim 1 in which the peripheral collar is integral with the collapsible bag.

10. A liquid storage tank according to claim 1 in which the inflatable collar is connected to an external pressurising source to enable inflation and maintenance of inflation.

11. A liquid storage tank according to claim 1 in which one or more lines or ropes is connected between the collapsible bag and the tank to provide further support for the collapsible bag.

12. A liquid storage tank according to claim 1 in which the collapsible bag is spaced by the peripheral collar from the side walls of the tank by a distance of 1 to 10% of the tank depth.

13. A liquid storage tank according to claim 1 in which the collapsible bag is fabricated in sections.

* * * * *

UNITED STATES PATENT AND TRADEMARK OFFICE

CERTIFICATE OF CORRECTION

PATENT NO. : 4,079,856

DATED : March 21, 1978

INVENTOR(S) : Paul Hammond Drake

It is certified that error appears in the above-identified patent and that said Letters Patent are hereby corrected as shown below:

Col. 2, line 16, change "0.05" to -- 0.5 -- .

Signed and Sealed this

*Eighteenth* Day of *July 1978*

[SEAL]

*Attest:*

RUTH C. MASON
*Attesting Officer*

DONALD W. BANNER
*Commissioner of Patents and Trademarks*